US007575117B2

(12) United States Patent
Redzisz et al.

(10) Patent No.: US 7,575,117 B2
(45) **Date of Patent: *Aug. 18, 2009**

(54) TOOL CARRYING AND STORAGE CASE

(75) Inventors: Andrezj M. Redzisz, Wheeling, IL (US); Donald E. Godshaw, Evanston, IL (US); Hai Du, Mount Prospect, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 478 days.

This patent is subject to a terminal disclaimer.

(21) Appl. No.: 11/260,540

(22) Filed: Oct. 27, 2005

(65) Prior Publication Data

US 2006/0037881 A1 Feb. 23, 2006

Related U.S. Application Data

(63) Continuation-in-part of application No. 10/982,319, filed on Nov. 4, 2004, now Pat. No. 6,991,104, which is a continuation of application No. 10/393,125, filed on Mar. 20, 2003, now Pat. No. 6,823,992.

(60) Provisional application No. 60/365,966, filed on Mar. 20, 2002.

(51) Int. Cl.
*B65D 85/28* (2006.01)

(52) U.S. Cl. ..... 206/373

(58) Field of Classification Search ..... 206/349, 206/362, 372–379; 190/18 A
See application file for complete search history.

(56) References Cited

U.S. PATENT DOCUMENTS

| | | | |
|---|---|---|---|
| 1,322,354 | A | 11/1919 | Scholtes |
| 1,510,240 | A | 9/1924 | Myers |
| 1,614,910 | A | 1/1927 | Yarder |
| 1,649,976 | A | 11/1927 | Pomeranz |
| 1,815,106 | A | 7/1931 | Jostes |
| 2,006,673 | A | 7/1935 | Crawford |
| D125,448 | S | 2/1941 | Kennedy |
| 2,337,860 | A | 12/1943 | Zeitenberg |
| D142,272 | S | 8/1945 | Dernehl |

(Continued)

FOREIGN PATENT DOCUMENTS

EP 0 345 115 A2 12/1989

(Continued)

OTHER PUBLICATIONS

Related U.S. Patent Nos. 6,823,992 and 6,991,104 are the subject of litigation in the case captioned *Outside the Box Innovations, LLC d/b/a Union Rich USA, a/k/a Union Rich, LLC* v. *Travel Caddy, Inc., and Rooster Products d/b/a the Rooster Group*, Civil Action No. 1:05-CV-2482 (NDGa). See "Second Amended Answer and Counterclaim".

(Continued)

*Primary Examiner*—Kurt Fernstrom
(74) *Attorney, Agent, or Firm*—Banner & Witcoff, Ltd.

(57) ABSTRACT

A collapsible carrying case includes a faux bottom panel which may be folded between the collapsed condition and a fully open carrier case condition. The end panels of the carrier case are also foldable between the collapsed condition and fully open condition.

19 Claims, 9 Drawing Sheets

U.S. PATENT DOCUMENTS

| | | | | |
|---|---|---|---|---|
| 2,661,824 | A | 12/1953 | Nelson, Jr. | |
| 2,713,370 | A | 7/1955 | Quinn | |
| 2,740,517 | A | 4/1956 | Evans | |
| 2,795,258 | A | 6/1957 | Berry et al. | |
| 2,960,136 | A | 11/1960 | Ziff | |
| 2,960,137 | A | 11/1960 | Lipsitz | |
| D194,515 | S | 2/1963 | Dawson | |
| 3,346,733 | A | 10/1967 | Woolworth | |
| 3,359,873 | A | 12/1967 | Carle, et al. | |
| 3,892,331 | A | 7/1975 | Beck | |
| 4,058,210 | A | 11/1977 | Mitchell | |
| 4,122,944 | A | 10/1978 | De Napoli | |
| 4,143,695 | A | 3/1979 | Hoehn | |
| 4,210,186 | A | 7/1980 | Belenson | |
| 4,260,004 | A | 4/1981 | Domke | |
| D260,200 | S | 8/1981 | Siegel | |
| 4,304,330 | A | 12/1981 | Winkler | |
| 4,356,854 | A | 11/1982 | McGee | |
| 4,403,638 | A | 9/1983 | Baum | |
| 4,424,841 | A | 1/1984 | Smith | |
| 4,506,769 | A | 3/1985 | Franco et al. | |
| D279,618 | S | 7/1985 | Walker | |
| 4,610,286 | A | 9/1986 | Cyr | |
| 4,693,344 | A | 9/1987 | Shuler | |
| 4,784,304 | A | 11/1988 | Schweitzer | |
| 4,806,736 | A | 2/1989 | Schirico | |
| 4,836,374 | A | 6/1989 | Hutchins et al. | |
| 4,895,256 | A | 1/1990 | Johnston | |
| 4,903,859 | A | 2/1990 | Derby et al. | |
| D307,967 | S | 5/1990 | Lanius | |
| 4,921,151 | A | 5/1990 | Duvall | |
| 4,951,818 | A | 8/1990 | Johnson | |
| D314,219 | S | 1/1991 | Lo | |
| 4,993,551 | A | 2/1991 | Lindsay | |
| 5,002,401 | A | 3/1991 | Blackman | |
| 5,071,003 | A | 12/1991 | Freelander | |
| 5,117,952 | A | 6/1992 | Suh | |
| 5,158,369 | A | 10/1992 | Derby | |
| 5,174,447 | A | 12/1992 | Fleming | |
| 5,255,833 | A | 10/1993 | McAllister | |
| 5,267,679 | A | 12/1993 | Kamaya et al. | |
| D345,237 | S | 3/1994 | Stein | |
| D346,682 | S | 5/1994 | Trovato | |
| 5,323,922 | A | 6/1994 | Lapoint, Jr. et al. | |
| 5,356,004 | A | 10/1994 | Weinreb | |
| 5,378,005 | A * | 1/1995 | Norton | 280/47.26 |
| 5,423,611 | A | 6/1995 | Sherrard | |
| 5,725,037 | A * | 3/1998 | Faulhaber | 144/285 |
| 5,775,496 | A | 7/1998 | Cyr | |
| 5,813,445 | A | 9/1998 | Christman | |
| 5,813,530 | A | 9/1998 | Kornblatt | |
| 5,833,095 | A | 11/1998 | Russell et al. | |
| 5,954,193 | A | 9/1999 | Bartee | |
| 5,971,101 | A | 10/1999 | Taggart | |
| 6,109,403 | A | 8/2000 | Godshaw | |
| 6,129,210 | A | 10/2000 | Rustemeyer et al. | |
| 6,129,254 | A * | 10/2000 | Yu | 224/575 |
| 6,138,827 | A | 10/2000 | Marshall | |
| 6,161,665 | A | 12/2000 | Hoover | |
| 6,182,878 | B1 | 2/2001 | Racca | |
| 6,237,761 | B1 | 5/2001 | Godshaw et al. | |
| 6,279,740 | B1 | 8/2001 | Dorman | |
| 6,347,847 | B1 * | 2/2002 | Tiramani et al. | 312/108 |
| 6,481,574 | B1 | 11/2002 | Pakosh | |
| D474,891 | S * | 5/2003 | Huang | D3/309 |
| D476,482 | S | 7/2003 | Yap | |
| 6,595,687 | B2 | 7/2003 | Godshaw et al. | |
| 6,601,930 | B2 * | 8/2003 | Tiramani et al. | 312/108 |
| 6,736,265 | B2 * | 5/2004 | Kipper et al. | 206/373 |
| D493,304 | S | 7/2004 | Shaw | |
| 6,915,902 | B2 * | 7/2005 | Brouard | 206/373 |
| 7,004,481 | B1 * | 2/2006 | Stanish | 280/37 |
| 7,044,277 | B2 | 5/2006 | Redzisz | |
| 7,311,200 | B2 * | 12/2007 | Godshaw et al. | 206/373 |
| 7,331,454 | B2 * | 2/2008 | Godshaw et al. | 206/373 |

FOREIGN PATENT DOCUMENTS

| | | |
|---|---|---|
| JP | 3-123505 | 5/1991 |
| JP | 11-346818 | 12/1999 |

OTHER PUBLICATIONS

*Outside the Box Innovations, LLC d/b/a Union Rich Usa, a/k/a Union Rich, LLC* v. *Travel Caddy, Inc., and Rooster Products d/b/a the Rooster Group*, in the United States District Court Northern District of Georgia Atlanta Division, Plaintiffs Invalidity Contentions, pp. 1-5, Jan. 1 2006.

*Outside the Box Innovations, LLC d/b/a Union Rich Usa* v. *Travel Caddy, Inc., and Rooster Products d/b/a the Rooster Group, Travel Caddy, Inc.* v. *Outside the Box Innovations, LLC d/b/a Union Rich Usa, Union Rich Plastic Factory, Ltd., Bonaka Plastic Manufacturing Co., Ltd., and Bonaka Limited*, In the United States District Court for the Northern District of Georgia Atlanta Division, Plaintiffs Supplement to LPR 4.3 Invalidity Contentions, pp. 1-154, May 3, 2006.

*Outside the Box Innovations, LLC d/b/a Union Rich USA* v. *Travel Caddy, Inc.*, and *Rooster Products d/b/a the Rooster Group, Travel Caddy, Inc.* v. *Outside the Box Innovations, LLC d/b/a Union Rich Usa, Union Rich Plastic Factory, Ltd., Bonaka Plastic Manufacturing Co., Ltd., and Bonaka Limited*, In the United States District Court for the Northern District of Georgia Atlanta Division, Plaintiffs Second Supplement to LPR 4.3 Invalidity Contentions, pp. 1-35, May 22, 2006.

*Outside the Box Innovations, LLC d/b/a Union Rich Usa* v. *Travel Caddy, Inc.*, and *Rooster Products d/b/a the Rooster Group, Travel Caddy, Inc.* v. *Outside the Box Innovations, LLC d/b/a Union Rich Usa, Union Rich Plastic Factory, Ltd., Bonaka Plastic Manufacturing Co., Ltd., and Bonaka Limited*, In the United States District Court for the Northern District of Georgia Atlanta Division, Plaintiffs Amendment & Third Supplement to LPR 4.3 Invalidity Contentions, pp. 1-184, Jul. 5, 2006.

*Outside the Box Innovations, LLC d/b/a Union Rich Usa* v. *Travel Caddy, Inc.*, and *Rooster Products d/b/a the Rooster Group, Travel Caddy, Inc.* v. *Outside the Box Innovations, LLC d/b/a Union Rich USA, Union Rich Plastic Factory, Ltd., Bonaka Plastic Manufacturing Co., Ltd., and Bonaka Limited*, In the United States District Court for the Northern District of Georgia Atlanta Division, Union Rich's Response to the Court's sua sponte Order for Direction, pp. 1-154, Jul. 27, 2006.

*Outside the Box Innovations, LLC d/b/a Union Rich Usa* v. *Travel Caddy, Inc.*, and *Rooster Products d/b/a the Rooster Group, Travel Caddy, Inc.* v. *Outside the Box Innovations, LLC d/b/a Union Rich Usa, Union Rich Plastic Factory, Ltd., Bonaka Plastic Manufacturing Co., Ltd., and Bonaka Limited*, In the United States District Court for the Northern District of Georgia Atlanta Division, Plaintiffs/ Counter-Defendants's and Counter-Defendants' Answer and Counterclaim to Defendants Travel Caddy, Inc.'s, and Rooster Products' (d/b/a the Rooster Group) Second Amended.

*Outside the Box Innovations, LLC d/b/a Union Rich Usa, a/k/a Union Rich, LLC* v. *Travel Caddy, Inc. and Rooster Products d/b/a the Rooster Group*, In the United States District Court Northern District of Georgia Atlanta Division, Order pp. 1-29, Sep. 18, 2006.

*Outside the Box Innovations, LLC d/b/a Union Rich USA/ a/k/a Union Rich LLC* v. *Travel Caddy, Inc. and Rooster Products d/b/a the Rooster Group*, In the United States District Court Northern District of Georgia Atlanta Division, Order pp. 1-25, Mar. 27, 2007.

*Outside the Box Innovations, LLC d/b/a Union Rich USA a/k/a Union Rich LLC* v. *Travel Caddy, Inc. and Rooster Products d/a/a the Rooster Group*, In the United States District Court Northern District of Georgia Atlanta Division, Order pp. 1-62, Dec. 19, 2008.

*Outside the Box Innovations, LLC d/b/a Union Rich USA* v. *Travel Caddy, Inc.*, and *Rooster Products d/b/a the Rooster Group, Travel Caddy, Inc.* v. *Outside the Box Innovations, LLC d/b/a Union Rich USA, Union Rich Plastic Factory, Ltd., Bonaka Plastic Manufactur-*

*ing Co., Ltd., and Bonaka Limited*, in the United States District Court for the Northern District of Georgia Atlanta Division, Plaintiffs Second Supplement to LPR 4.3 Invalidity Contentions, pp. 1-35, May 22, 2006.

*Outside the Box Innovations, LLC d/b/a Union Rich USA* v. *Travel Caddy, Inc.*, and *Rooster Products d/b/a The Rooster Group, Travel Caddy, Inc.* v. *OUtside the Box Innovations, LLC d/b/a Union Rich USA, Union Rich Plastic Factory, Ltd., Bonaka Plastic Manufacturing Co., Ltd., and Bonaka Limited*, In the United States District Court for the Northern District of Georgia Atlanta Division, Plaintiff's Amendment & Third Supplement to LPR 4.3 Invalidity Contentions, pp. 1-184, Jul. 5, 2006.

*Outside the Box Innovations, LLC d/b/a Union Rich USA* v. *Travel Caddy, Inc.*, and *Rooster Products d/b/a The Rooster Group, Travel Caddy, Inc.* v. *Outside the Box Innovations, LLC d/b/a Union Rich USA, UNion Rich Plastic Factory, Ltd., Bonaka Plastic Manufacturing Co., Ltd., and Bonaka Limited*, In the UNited States District Court for the Northern District of Georgia Atlanta Division, Union Rich's Response to the Court's sua sponte Order for Direction, pp. 1-154, Jul. 27, 2006.

*Outside the Box Innovations, LLC d/b/a Union Rich USA* v. *Travel Caddy, Inc.*, and *Rooster Products d/b/a The Rooster Group, Travel Caddy, Inc.* v. *Outside the Box Innovations, LLC d/b/a/ Union Rich USA, Union Rich Plastic Factory, Ltd., Bonaka Plastic Manufacturing Co., Ltd., and Bonaka Limited*, In the United States District Court for the Northern District of Georgia Atlanta Division, Plaintiffs/ Counter-Defendants's and Counter-Defendants' Answer and Counterclaim to Defendants Travel Caddy, Inc.'s, and Rooster Products' (d/b/a The Rooster Group) Second Amended.

*Outside the Box Innovations, LLC d/b/a Union Rich USA, a/k/a Union Rich, LLC* v. *Travel Caddy, Inc., and Rooster Products d/b/a the Rooster Group*, in the United States District Court Northern District of Georgia Atlanta Division, Order pp. 1-29, Sep. 18, 2006.

*Outside the Box Innovations, LLC d/b/a Union Rich USA, a/k/a Union Rich, LLC* v. *Travel Caddy, Inc., and Rooster Products d/b/a the Rooster Group*, in the United States District Court Northern District of Georgia Atlanta Division, Order pp. 1-25, Mar. 27, 2007.

* cited by examiner

FIG.3
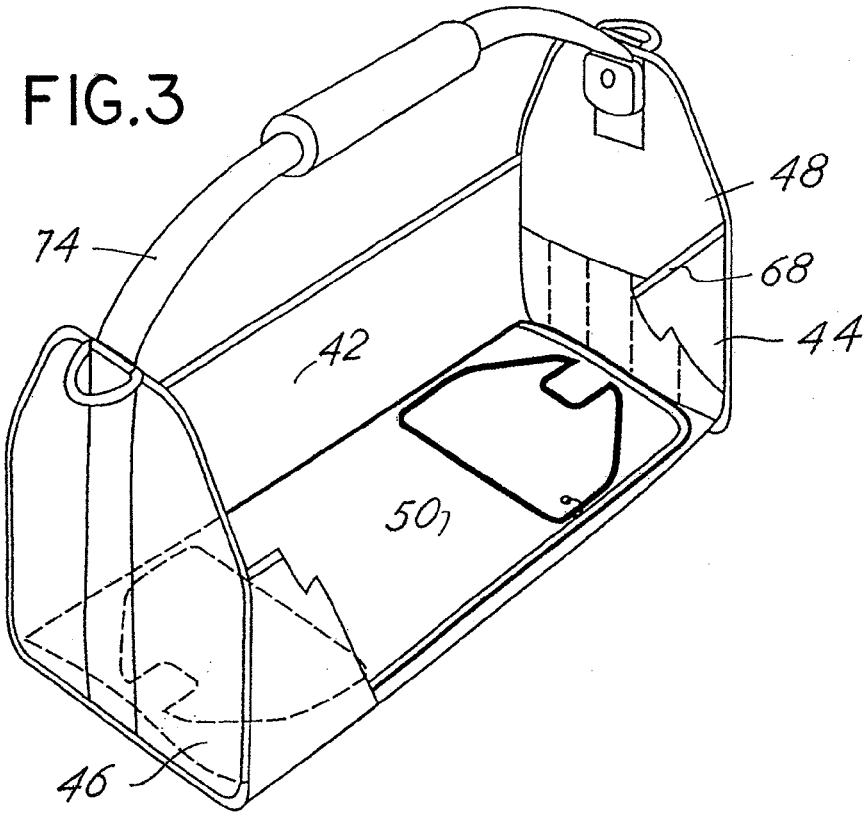
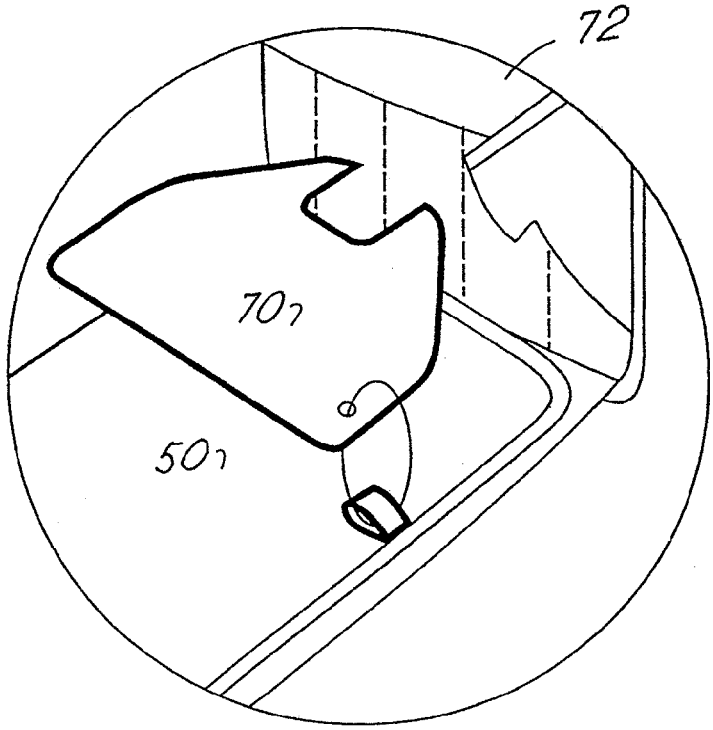
FIG.4

FIG. 5
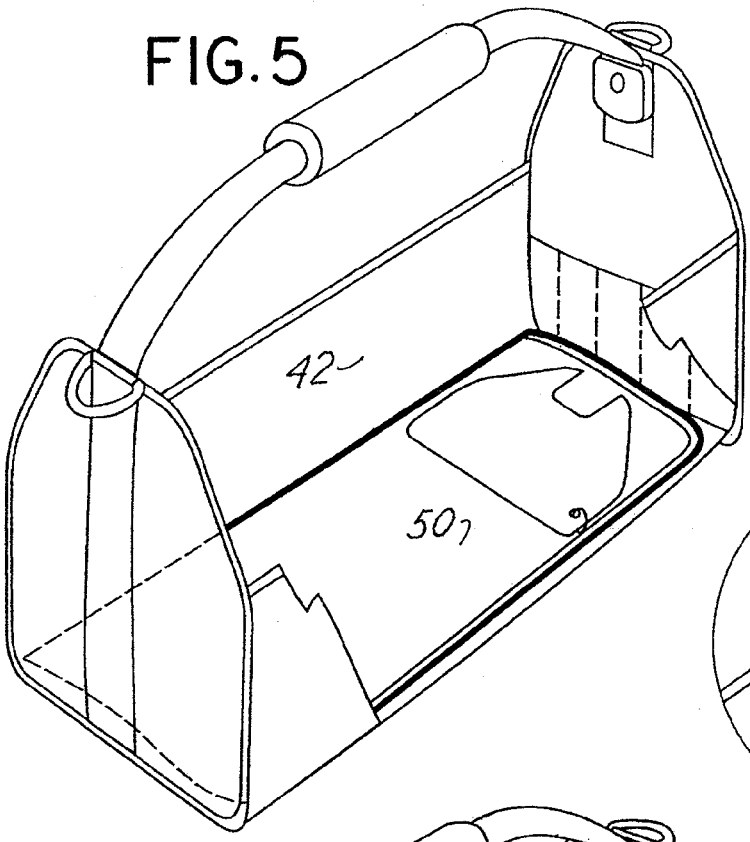
FIG. 7
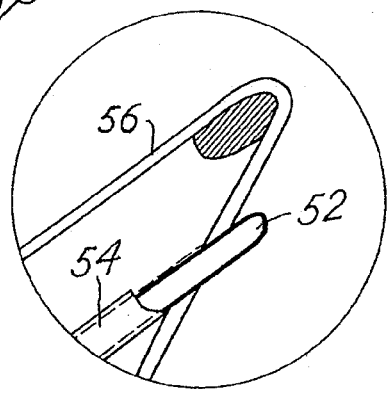
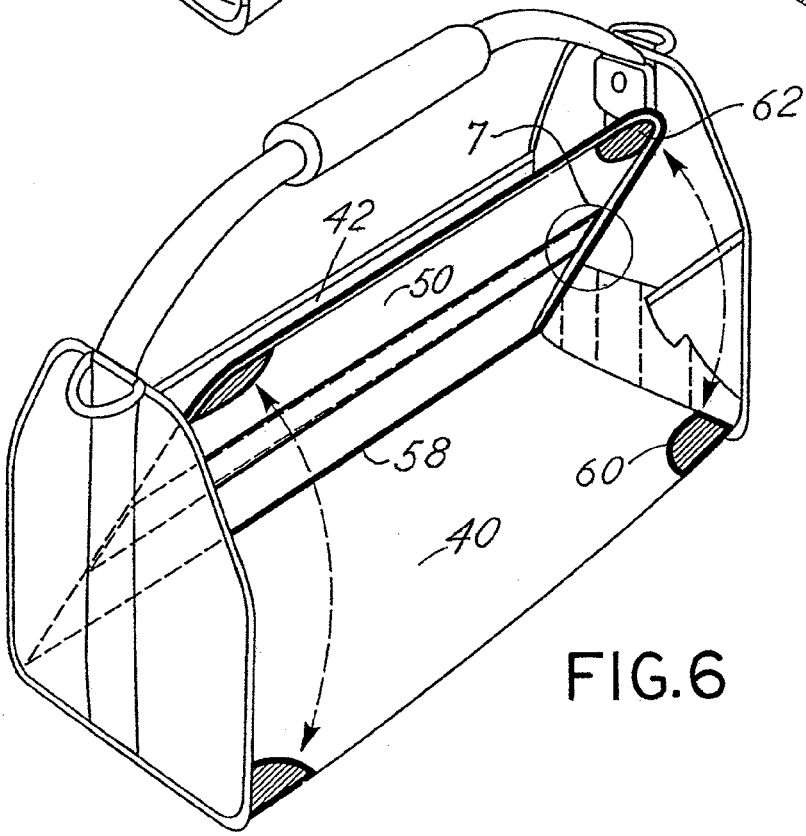
FIG. 6

TOOL CARRYING AND STORAGE CASE

CROSS REFERENCE TO RELATED APPLICATION

This is a continuation-in-part application of Ser. No. 10/982,319 filed Nov. 4, 2004, entitled "Tool Carrying and Storage Case" which is a continuation application of Ser. No. 10/393,125, filed Mar. 20, 2003, entitled "Tool Carrying and Storage Case", now U.S. Pat. No. 6,823,992, which is the utility application based upon provisional application Ser. No. 60/365,966 filed Mar. 20, 2002 entitled "Tool Carrying and Storage Case" for which priority is claimed and which are incorporated herewith by reference.

BACKGROUND OF THE INVENTION

In a principal aspect, the present invention relates to a storage case for carrying tools and other items.

Gardeners, tradesmen, workmen and the like often transport their tools and/or equipment in an open top carrying case. An open top carrying case enables quick access to the contents of the case. Such a case also facilitates carrying of multiple tools and items necessary for performance of work. Desirable features of such a carrying case are that it be rugged, flexible, yet have a certain degree of structural integrity so that the tools or items carried in the case will be protected and will not deform the case due to their weight. Additionally, a carrying case for tools should be capable of including special storage pockets and other features for separating and transporting tools. Also, handles or carrying straps are desirable features for a carrying case.

With these objectives in mind, the present invention comprises an extremely cost effective, yet especially rugged and aesthetically pleasing design for a tool carrying case.

SUMMARY OF THE INVENTION

Briefly, the present invention comprises a collapsible tool carrier which is comprised of a series of panels including a bottom panel of generally flexible material, a first lateral side panel, a second lateral side panel spaced from the first side panel, and generally parallel, spaced end panels to thereby form an enclosure or case with an open top side. A handle connects the end panels and is pivotally or rotatably attached thereto. The end panels are comprised of flexible material, but include vertical pockets which permit the insertion of stiffening inserts. A faux bottom panel may be folded against the flexible material bottom panel. The faux bottom panel may also be folded against one of the side panels. The end panels are collapsible or foldable. Thus, the faux bottom panel may be folded against a lateral or side panel and then the lateral side panels may be compressed toward one another so that the entire carrier may be collapsed for purposes of storage, shipping, packaging and the like.

Therefore, it is an object of the invention to provide an improved folding or collapsible tool carrier.

It is another object of the invention to provide an economical yet rugged folding or collapsible tool carrier.

A further object of the invention is to provide an open top tool carrier which incorporates a rigid carry handle and that may be converted between an open position and a closed or folded position.

These and other objects, advantages and features of the invention will be set forth in the detailed description that follows.

BRIEF DESCRIPTION OF THE DRAWING

In the detailed description which follows, reference will be made to the drawing comprised of the following figures:

FIG. 3 is a cut-away isometric view of the tool carrier of FIG. 1;

FIG. 4 is an enlarged isometric view of a portion of FIG. 3;

FIG. 5 is an isometric view of the carrier of FIG. 1 similar to FIG. 3;

FIG. 6 is an enlarged isometric view of the carrier of FIG. 1 depicting the manner in which the faux bottom panel of the carrier is folded to permit collapse of the carrier;

FIG. 7 is an enlarged isometric view of a stiffening mechanism associated with the faux bottom of the carrier of FIG. 6;

DESCRIPTION OF THE PREFERRED EMBODIMENT

Figures 1, 2:
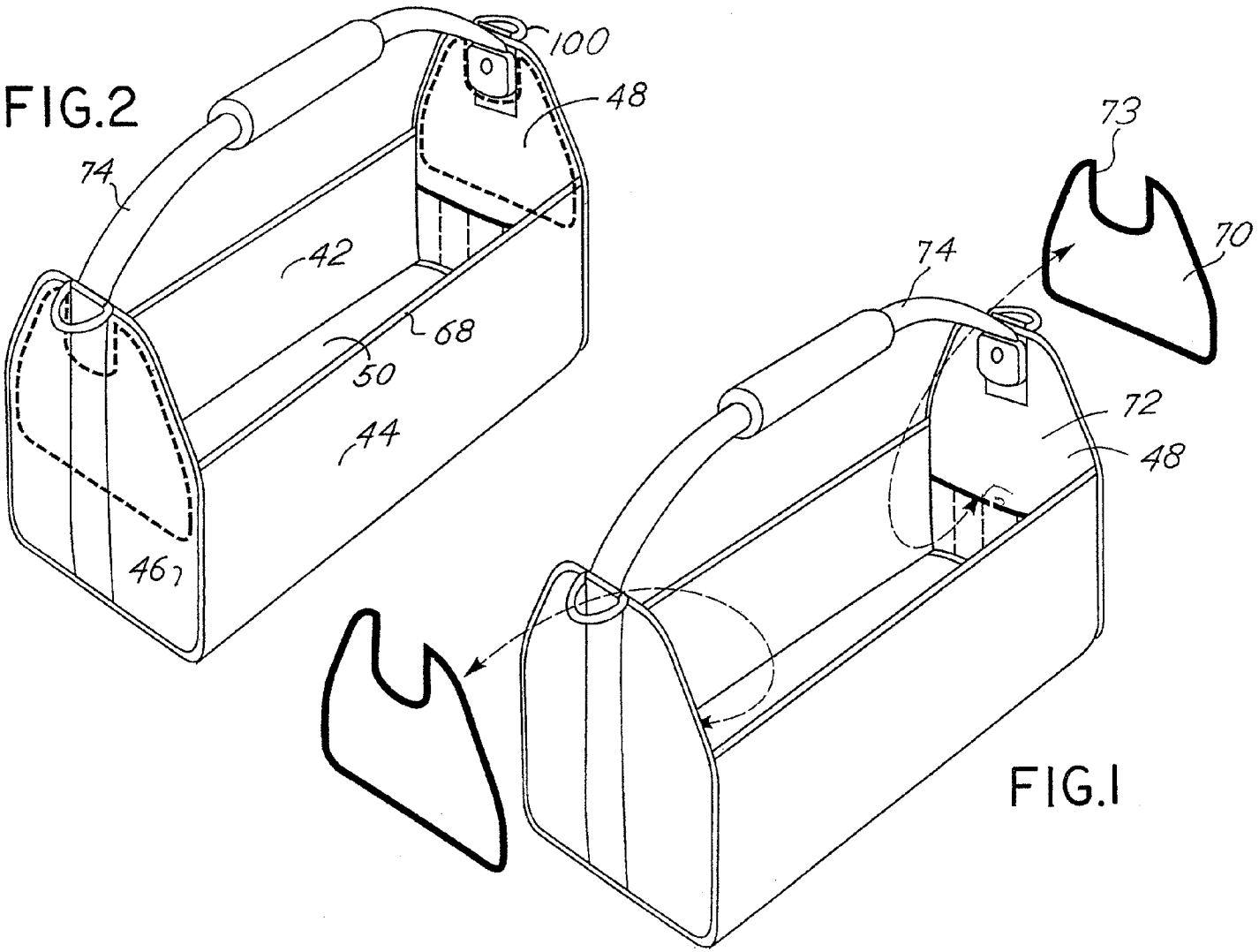
FIG. 1 is an isometric view depicting an embodiment of the collapsible tool carrier of the invention.
FIG. 2 is an exploded isometric view of the tool carrier of FIG. 1.
Figure 8:
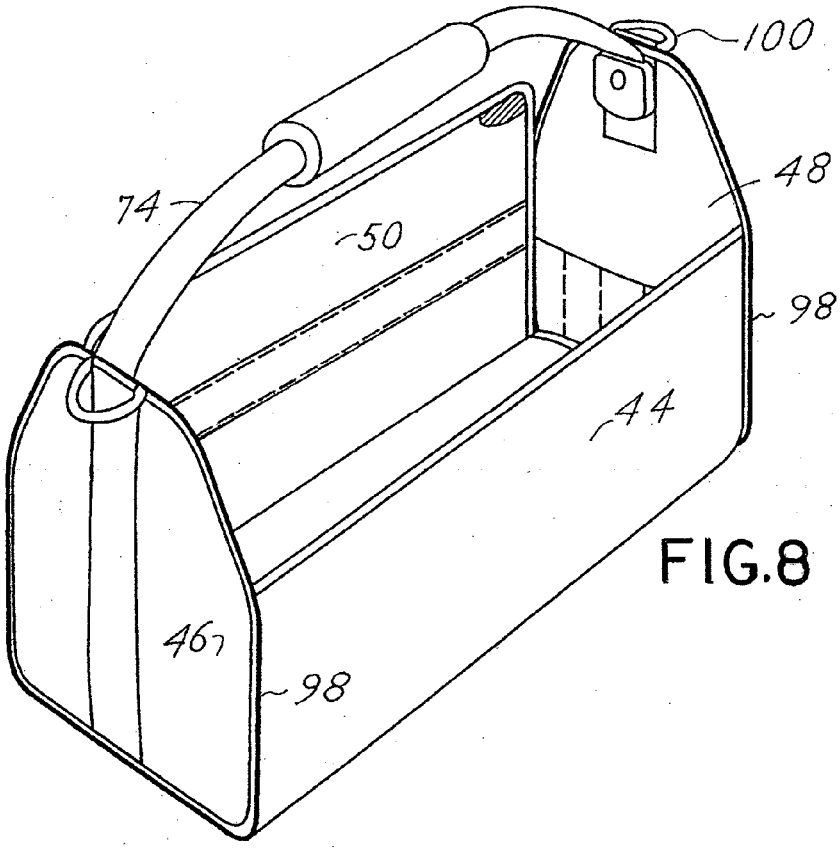
FIG. 8 is an isometric view of the tool carrier in a partially folded condition.

The carrier of the invention may be utilized by tradesmen, workmen, craftsmen and the like. The carrier is often termed a tote or a tool bag. The carrier of the invention is comprised of a generally rectangular bottom panel 40, a first lateral side panel 42, a second, generally rectangular, lateral side panel 44 parallel to first side panel 42, a first end panel 46 and a second, generally parallel end panel 48 spaced from first end panel 46.

A faux bottom panel 50 has a generally congruent size and shape with respect to the bottom panel 40. The faux bottom panel 50 is generally rectangular and includes a stiffening element or mechanism. For example, as depicted in FIG. 7, a wire reinforcing member 52 may be inserted into a pocket 54 to provide a stiffening feature for the faux bottom panel 50. The faux bottom panel 50 may further include a peripheral reinforcing wire 56. In any event, the faux bottom panel 50 is preferably stiffened by any of a number of mechanisms or constructions.

The faux bottom panel 50 is hinged along a side edge 58 to a lower bottom lateral side edge of the bottom panel 40 where it is connected to or joins with the first lateral side panel 42. In this manner, faux bottom panel 50 may be folded about the lateral side edge 58 and fitted over or against the bottom panel 40. Fastening means such as hook and loop fasteners 60 and 62 may be utilized to hold the faux bottom panel 50 in position on the bottom panel 40. The combination of the faux bottom panel 50 and the bottom panel 40 thus provides a rigid bottom or inside support surface for the carrier of the invention. The bottom panel 40 is, however, generally flexible and made from a cloth, canvas or plastic material which is flexible.

The lateral side panels 42 and 44 are generally rectangular in shape and may be comprised of a continuation of the fabric forming the bottom panel 40. Ribbing or cording, such as cording 68, may form an exposed edge of the panels such as the lateral side panel 44, for example.

The end panels 46 and 48 are constructed in a manner whereby they may be collapsed. An embodiment of the collapsible construction is described hereinafter. Specifically, the end panels 46, 48 are generally of congruent configuration. They are comprised of a lower section which is generally rectangular and an upper section which is generally trapezoidal or triangular or truncated triangular. The upper generally truncated triangular portion is cooperative with a transverse stiffening element 70 which spans the open end panel 48 laterally and fits within a pocket 72 in the end panel, for example, end panel 48. The stiffening element 70 includes a notch 73 which is sized to accommodate a connecting device for a handle 74 as described in greater detail hereinafter.

The end panel 48 and the end panel 46 are generally substantially identical in construction. Each of the end panels 46 and 48 is comprised of a series of five vertical, generally rectangular rib sections or ribs 80, 82 84, 86 and 88. The rib sections 80, 82, 84, 86 and 88 generally define the configuration of the end panel 48. The ribs 80, 82, 84, 86 and 88 include vertical stiffening elements positioned between layers of fabric 90 and 92 and are retained in stitched pockets. The ribs may be formed from a polyethylene material or bamboo or other stiffening means. Thus, the ribs may include a pocket such as the pocket 96 which receives a stiffening element 98 such as a wire rod or bamboo strip or the like.

Figures 21, 22, 23:
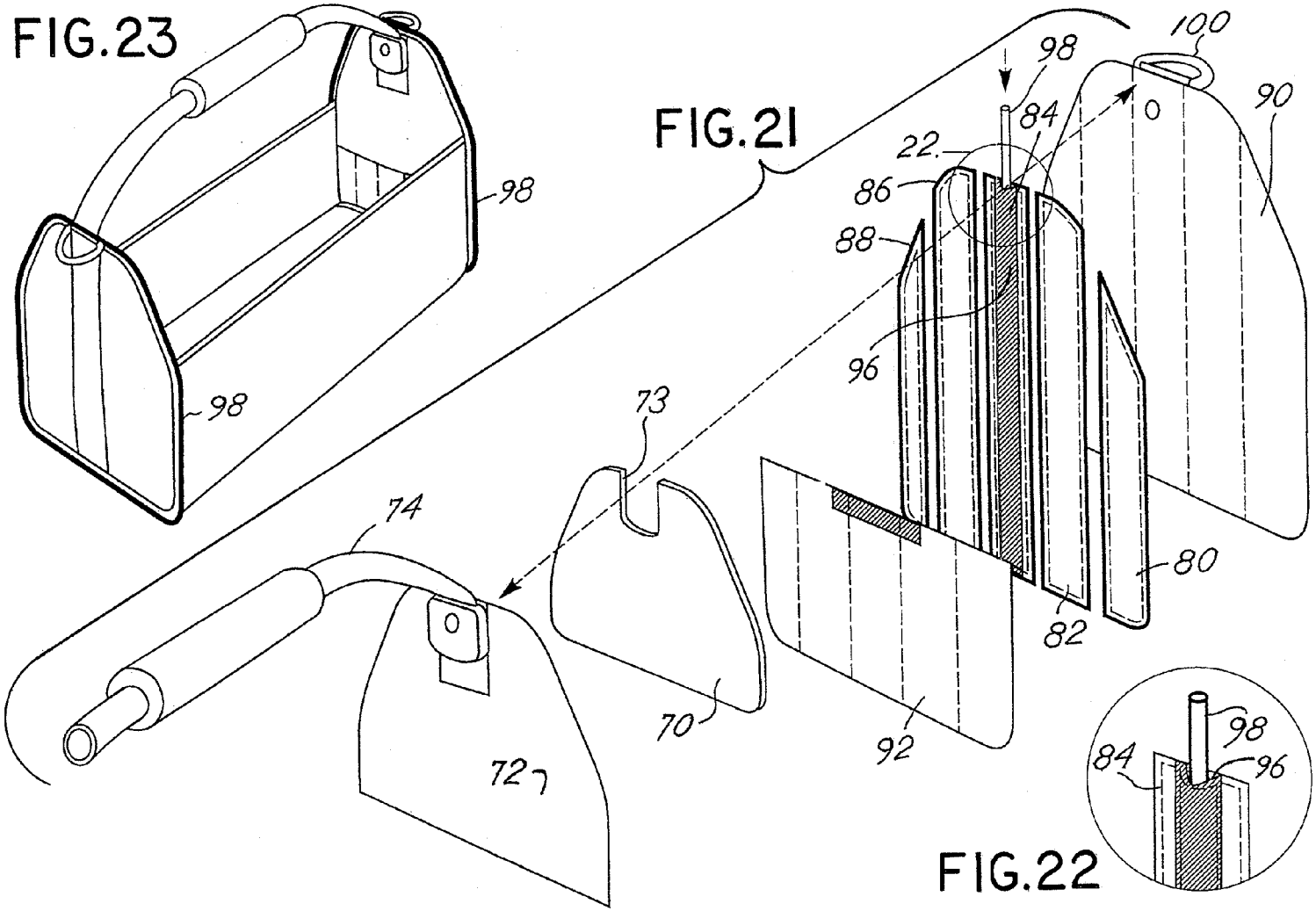
FIG. 21 is an exploded isometric view of the component parts forming the end panel and handle construction for the carrier.
FIG. 22 is an enlarged isometric view of a stiffening element used for an end panel of the carrier.
FIG. 23 is a folded assembled isometric view of the tool carrier of the invention.

In any event, the middle rib 84 is stiffened as are the other side ribs 80, 82, 86 and 88. The stiffening member or board 70 provides lateral or side to side stiffening of the entire end panel 46, 48. The vertical ribs 80, 82, 84, 86 and 88 provide horizontal stiffening of the end panel 48 as well as the end panel 46. The various described parts forming the end panels 46, 48 are retained by a peripheral binding 98, for example, as depicted in FIG. 23. Thus, a fabric or cloth outer layer 90 and internal cloth layers 72 and 92 encapsulate the stiffening board 70 as well as the stiffening ribs 80, 82, 84, 86 and 88. An optional carrier ring 100 for attachment of a carry strap may be affixed to the middle rib 84 as depicted, for example, in FIG. 21.

Figure 11:
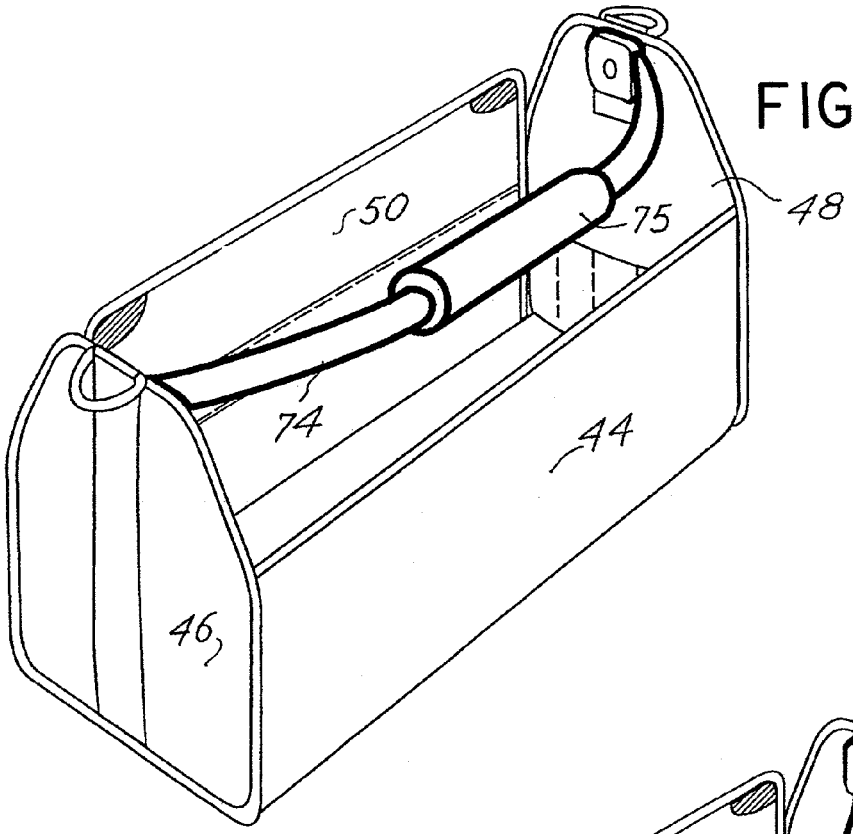
FIG. 11 is an isometric view depicting the manner in which a handle of the tool carrier may be folded.
Figure 12:
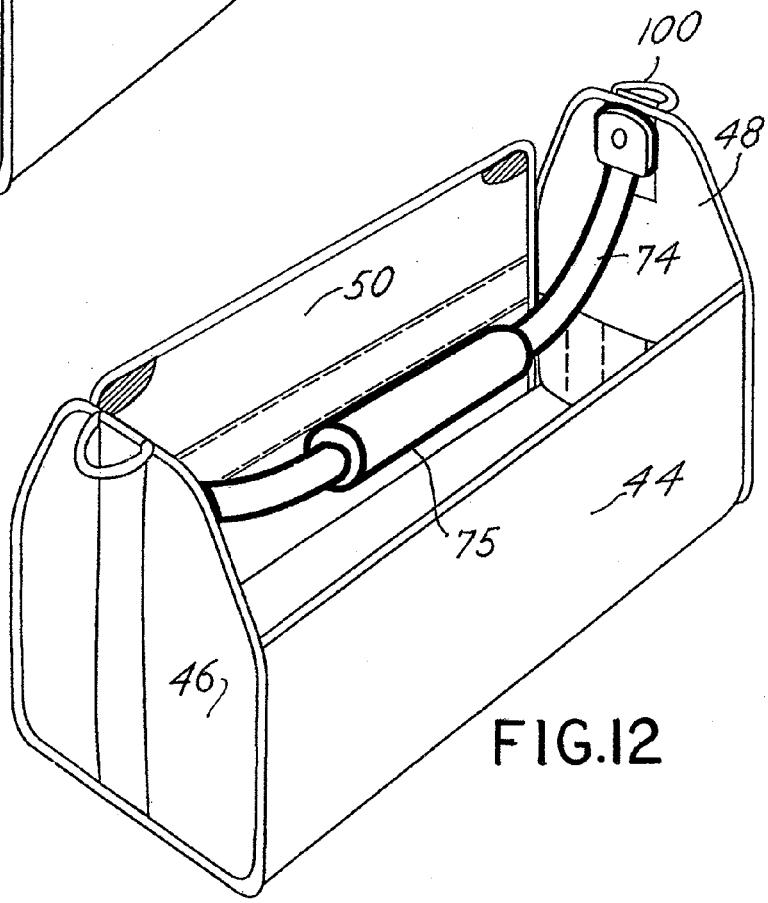
FIG. 12 is an isometric view illustrating further folding of the tool carrier of FIG. 11.

The handle 74 includes a center hand grip 75 and is arcuately shaped to facilitate carrying of the tool carrier in its fully open or assembled condition. Each end of the handle 74 includes a flat connection plate 77 with an opening 79 for receipt of a rivet or fastener 81 that fits through a fitting 83 that is attached to end panel 46 or 48 and to the center or middle reinforcing rib 84. The handle 74 is pivotal about the axis of the rivet or fastener 81, for example, as depicted in FIGS. 11 and 12 as well as FIG. 13. Thus, the handle 74 may be pivoted to a fully open position from the positions illustrated, for example, in FIGS. 12 and 13. FIG. 11 depicts the handle partially pivoted between the closed or packed position and a fully open position, for example, as depicted in FIG. 1.

Figure 9:
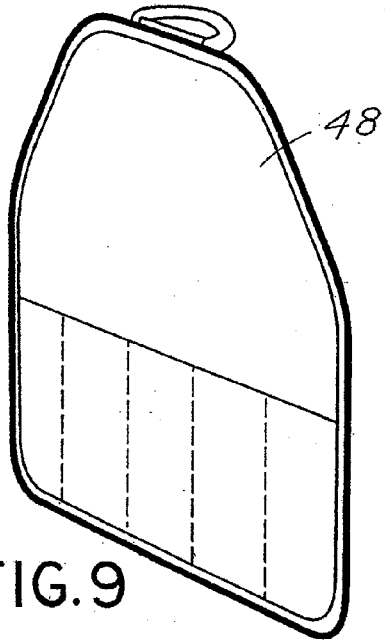
FIG. 9 is an isometric view of an end panel of the tool carrier.
Figure 10:
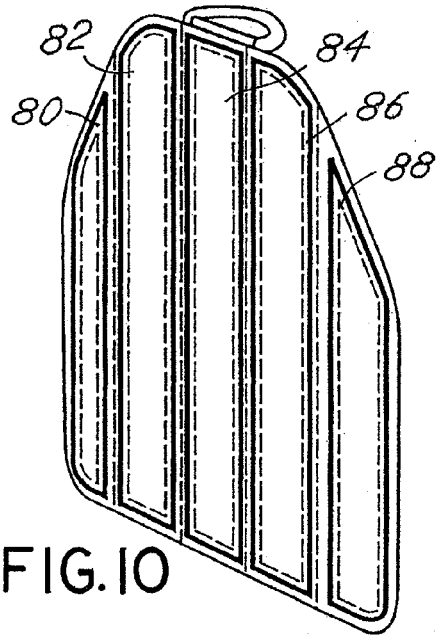
FIG. 10 is an isometric view of the internal construction of the end panel of FIG. 9.
Figure 13:
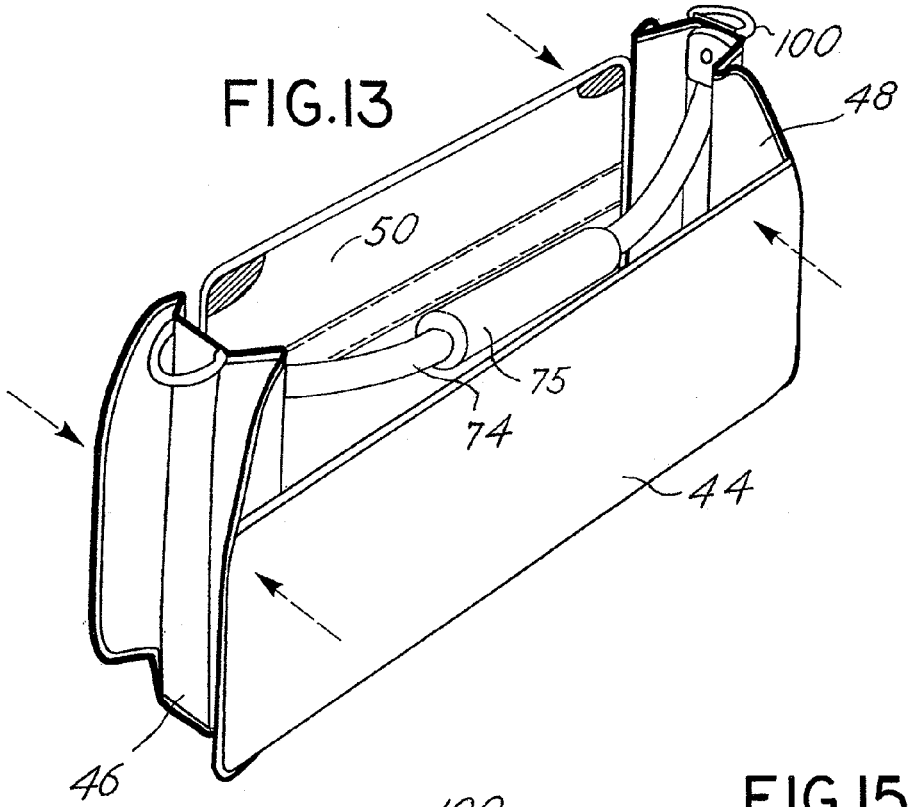
FIG. 13 is an isometric view of the carrier in a partially folded condition.
Figure 14:
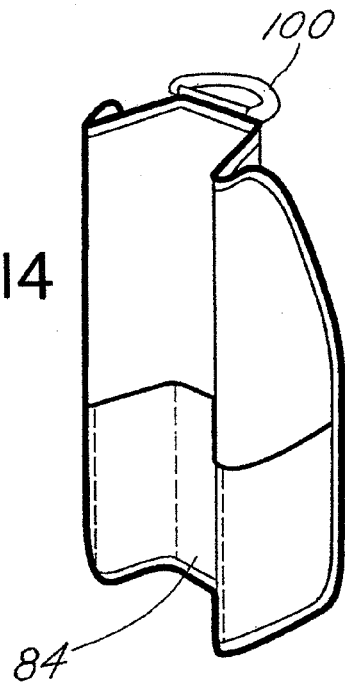
FIG. 14 is an isometric view of an end panel depicting partial folding thereof.
Figure 15:
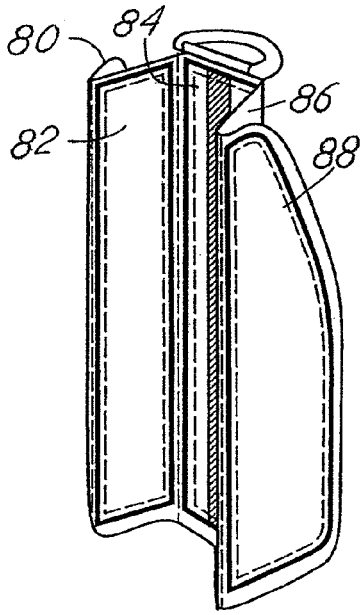
FIG. 15 is a partially cut away isometric view of the end panel of FIG. 14 depicting the manner of folding thereof.
Figure 16:
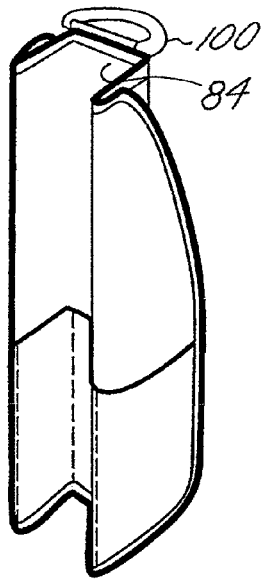
FIG. 16 is an isometric view of an end panel fully folded.
Figure 17:
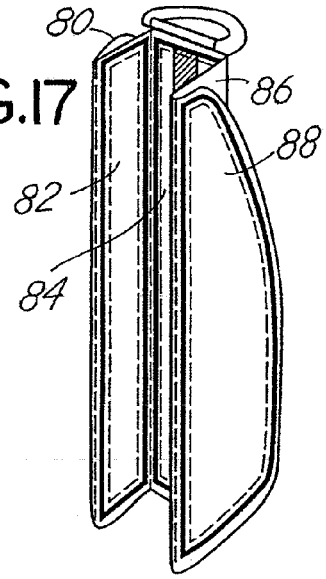
FIG. 17 is an isometric view illustrating the internal construction of the folded end panel of FIG. 16.
Figure 18:
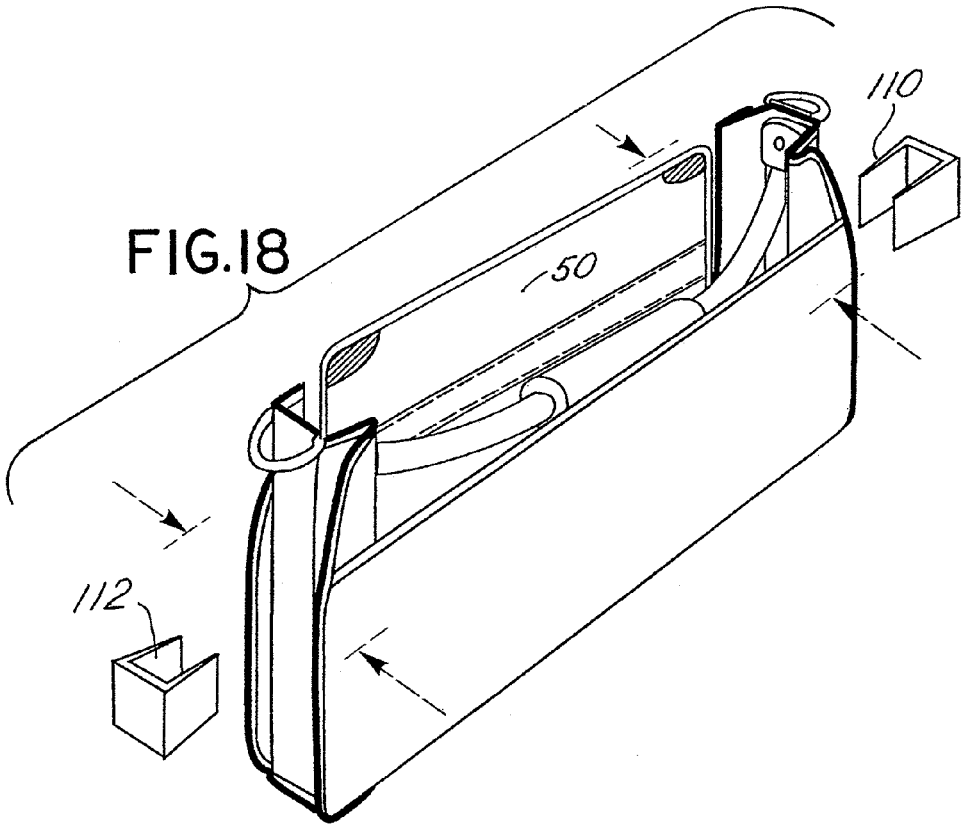
FIG. 18 is an isometric view of the fully folded carrier with clamping members attachable thereto for purposes of packaging, storage, etc.
Figure 19:
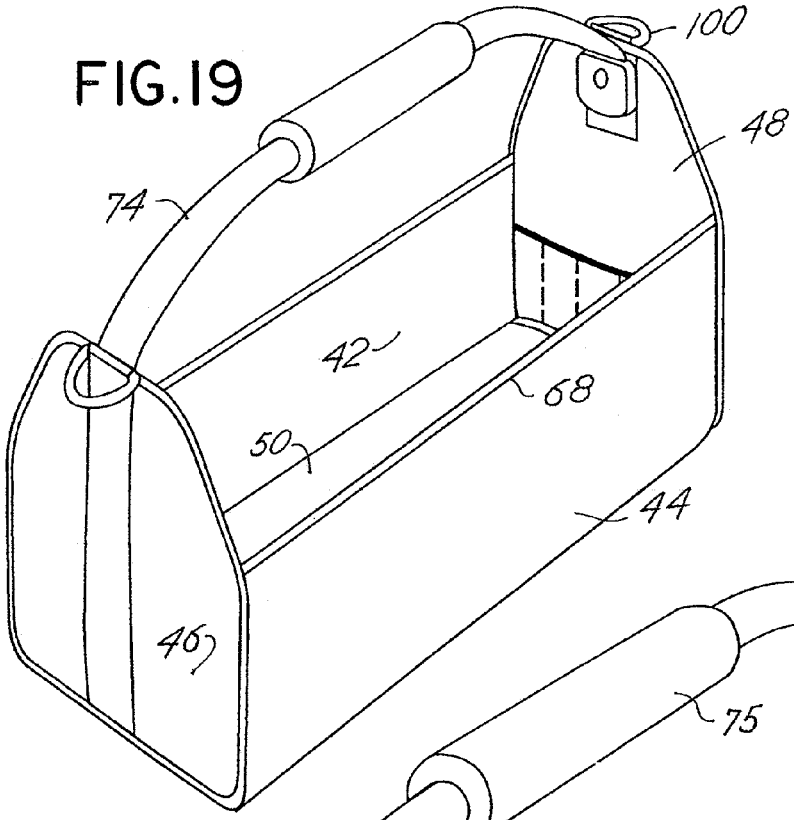
FIG. 19 is an isometric view of the tool carrier illustrating the attachment of the handle thereto.
Figure 20:
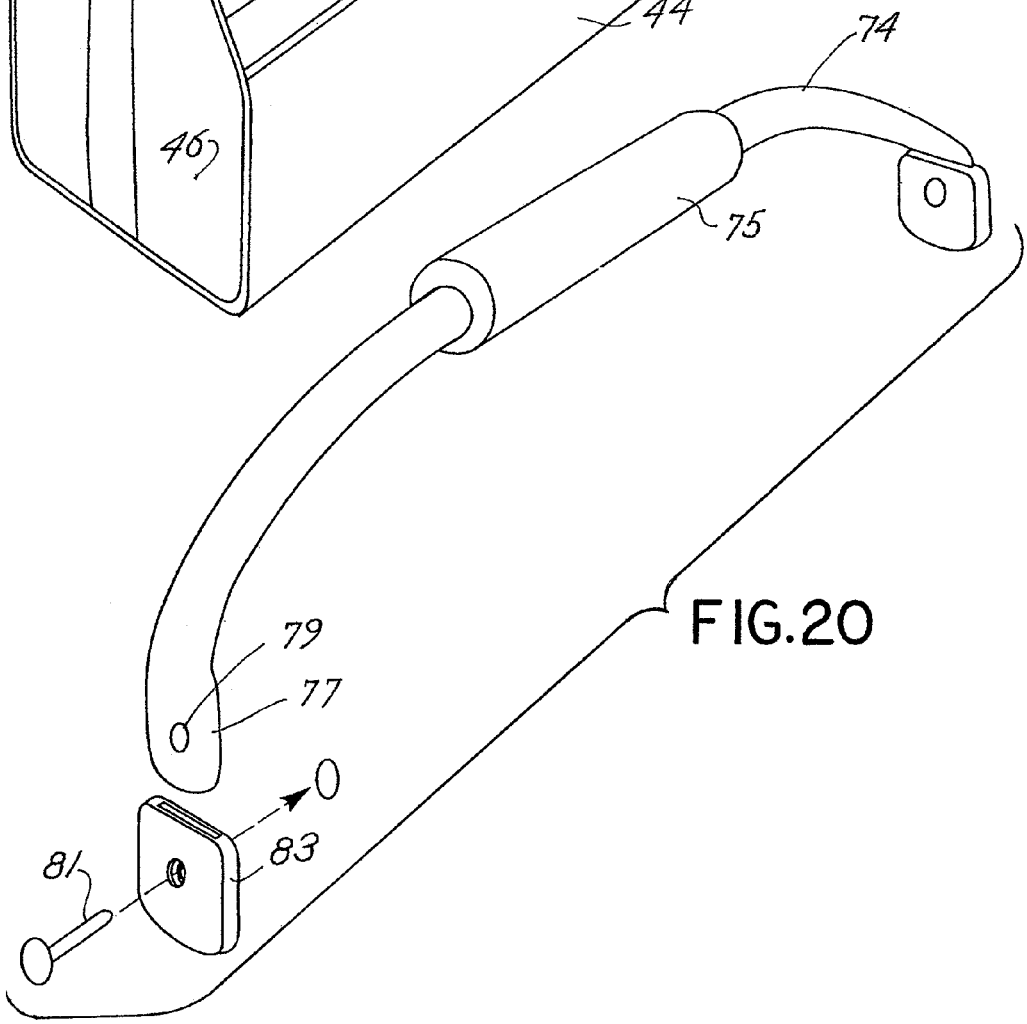
FIG. 20 is an exploded isometric view of the handle construction for the carrier.

With respect to the end panels 46 and 48, the number of vertical rigid supporting ribs 80, 82, 84, 86 and 88 is typically an uneven number. Thus, the middle rib 84 may be provided to accommodate width of the handle 74. The lateral side ribs 80 and 82 as well as ribs 86 and 88 may be folded between an expanded position, for example, as shown in FIGS. 9 and 10 and a contracted or folded position exemplified by the series of drawings FIGS. 14, 15, 16 and 17. Thus, the end panels 46, 48, upon removal of the stiffening board or stiffening member 70, may be folded or compacted stepwise into the configuration initially as depicted in FIG. 13 and ultimately to the condition illustrated in FIG. 18. Thus, the end panels 46 and 48 are collapsible. When collapsed, lateral sides 42 and 44 are moved together in opposed relation as the faux bottom panel 50 is fully folded upward against the lateral side panel 42. Retention clamps 110 and 112 may be utilized to retain the collapsed carrier, for example, as illustrated in FIG. 18. Thus, the carrier in the collapsed condition in FIG. 18 can be placed in a shipping box for purposes of transport or display. The carrier or tote of the invention, however, may be opened and assembled easily to form a generally fairly rigid, parallelepiped configured tool carrier such as depicted in FIGS. 1 and 2.

The stiffening elements 70 for the end panels 46 and 48 in combination with the generally rigid vertically extending ribs or sections 80, 82, 84, 86 and 88 provide a stiffening feature for the end panels 46 and 48. The faux bottom panel 50 provides a stiffening feature for maintaining the lateral sides 42 and 44 appropriately spaced and for appropriately supporting tools or other items within the carrier. The handle 74 provides a further end to end stiffening feature for the tool carrier. The inserts 70 provide lateral stiffening of end panels 46, 48. Thus, the carrier is foldable between a generally compact folded carrier position and a fully open position for use. The carry is collapsible for purposes of storage and transport yet may be opened to provide a rugged and strong carrier for tools and the like.

It is possible to vary the particular construction of the end panels 46 and 48 in order to provide both vertical as well as lateral stiffening thereof. The stiffening mechanism associated with the bottom faux panel 50 may also be varied. The particular shape and configuration of the pivotal handle 74 may also be varied without departing from the spirit and scope of the invention. The invention is therefore to be limited only by the following claims and equivalents thereof.

What is claimed is:

1. A collapsible tool carrier comprising, in combination:

a flexible material, generally rectangular bottom panel including a first lateral side edge, a second lateral side edge, a third end side edge extending between the first and second lateral side edges, a fourth end side edge generally parallel to the third end side edge and extending between the first and second lateral side edges;

a generally rigid faux bottom panel generally congruent with the bottom panel and hinged thereto along said first lateral side edge;

a first carrier side panel extending generally vertically from the first side edge of the bottom panel;

a second carrier side panel extending generally vertically from the second side edge of the bottom panel;

a first flexible, collapsible carrier end panel fastened to and extending generally vertically from the third end side edge of the bottom panel and connected to the first carrier side panel and the second carrier side panel, said first carrier end panel foldable to enable the carrier side panels to be moved into closely opposed relationship;

a second flexible, collapsible carrier end panel fastened to and extending generally vertically from the fourth end side edge of the bottom panel and connected to the first carrier side panel and the second carrier side panel, said second carrier end panel foldable to enable the carrier side panels to be moved into closely opposed relationship;

said panels forming alternatively a carrier case with the faux bottom panel folded is opposed relation to the bottom panel, and a compact folded carrier case with the faux bottom panel folded in opposed relation with the first carrier side panel intermediate between the first and second carrier side panels.

2. The carrier of claim 1 further including a pocket in at least one carrier end panel and a stiffening insert slidable into said pocket to maintain the said one end panel in a generally planar unfolded condition.

3. The carrier of claim 1 further including a pocket in each carrier end panel and a stiffening insert slidable into each said pocket to maintain each said end panel in a generally planar, unfolded condition.

4. The carrier of claim 2 wherein the insert is removable.

5. The carrier of claim 3 wherein the insert is removable.

6. The carrier of claim 1 further including a rigid handle extending between the first carrier end panel and second carrier end panel.

7. The carrier of claim 6 wherein the handle is attached at its opposite ends to the first carrier end panel and second carrier end panel at an upper side of said end panels approximately midway between the lateral sides of said end panels.

8. The carrier of claim 7 wherein the handle is pivotally attached to the carrier end panels for rotation about an axis extending between the end panels to permit folding of the handle.

9. The carrier of claim 1 wherein the collapsible carrier end panels each comprise a series of vertically extending, generally rectangular and rigid rib sections hinged together and foldable about said hinge connections.

10. The carrier of claim 9 wherein each collapsible carrier end panel is comprised of an uneven number of rigid sections.

11. The carrier of claim 9 wherein each collapsible carrier end panel is comprised of five rigid rib sections.

12. The carrier of claim 11 wherein the middle rib section of each carrier end panel is connected by a rigid handle bar.

13. The carrier of claim 1 wherein the faux bottom panel includes a pocket with a stiffener element in said pocket.

14. The carrier of claim 1 wherein the faux bottom panel includes a fastener for removably attaching the faux bottom panel to the bottom panel.

15. The carrier of claim 1 further including a separate removable clamp member for engaging panels of the carrier to retain the carrier as a collapsed carrier.

16. A collapsible tool carrier comprising, in combination:

a flexible material, generally rectangular bottom panel including a first lateral side edge, a second lateral side edge, a third end side edge extending between the first and second side edges, a fourth end side edge generally parallel to the third end side edge and extending between the first and second side edges;

a generally rigid faux bottom panel generally congruent with the bottom panel and hinged thereto along said first lateral side edge;

a first carrier side panel extending generally vertically from the first side edge of the bottom panel;

a second carrier side panel extending generally vertically from the second side edge of the bottom panel;

a first flexible, collapsible carrier end panel fastened to and extending generally vertically from the third end side edge of the bottom panel and connected to the first carrier side panel and the second carrier side panel, said first carrier end panel foldable to enable the carrier side panels to be moved into closely opposed relationship;

a second flexible, collapsible carrier end panel fastened to and extending generally vertically from the fourth end side edge of the bottom panel and connected to the first carrier side panel and the second carrier side panel, said second carrier end panel foldable to enable the carrier side panels to be moved into closely opposed relationship, said panels forming alternatively a carrier case with the faux bottom panel folded in opposed relation to the bottom panel, and a compact folded carrier case with the faux bottom panel folded in opposed relation with the first carrier side panel intermediate between the first and second carrier side panels; and a pocket in at least one carrier end panel and a stiffening insert slidable into said pocket to maintain the said one end panel in a planar unfolded condition.

17. A collapsible tool carrier comprising, in combination:

a flexible material, generally rectangular bottom panel including a first lateral side edge, a second, spaced generally parallel lateral side edge, a third end side edge extending between the first and second side edges, a fourth end side edge generally parallel to the third end side edge and extending between thee first and second side edges;

a generally rigid faux bottom panel generally congruent with the bottom panel and hinged thereto along said first lateral side edge;

a first carrier side panel extending generally vertically from the first side edge of the bottom panel;

a second carrier side panel extending generally vertically from the second side edge of the bottom panel;

a first flexible, collapsible carrier end panel fastened to and extending generally vertically from the third end side edge of the bottom panel and connected to the first carrier side panel and the second carrier side panel, said first carrier end panel foldable to enable the carrier side panels to be moved into closely opposed relationship;

a second flexible, collapsible carrier end panel fastened to and extending generally vertically from the fourth end side edge of the bottom panel and connected to the first carrier side panel and the second carrier side panel, said second carrier end panel foldable to enable the carrier side panels to be moved into closely opposed relationship, said panels forming alternatively a carrier case with the faux bottom panel folded in opposed relation to the bottom panel, and a compact folded carrier case with the faux bottom panel folded in opposed relation with the first carrier side panel intermediate between the first and second carrier side panels;

a pocket in each carrier and panel and a stiffening insert slidable into each said pocket to maintain each said end panel in a planar, unfolded condition; and further including a rigid handle extending between the first carrier end panel and second carrier end panel wherein the handle is attached at its opposite ends to the first carrier end panel and second carrier end panel at an upper side of said end panels approximately midway between the lateral sides of said end panels; and wherein the handle is pivotally attached to the carrier end panels for rotation about an axis extending between the end panels to permit folding of the handle.

18. A collapsible tool carrier comprising, in combination:

a flexible material, generally rectangular bottom panel including a first lateral side edge, a second, spaced generally parallel lateral side edge, a third end side edge extending between the first and second side edges, a fourth end side edge generally parallel to the third end side edge and extending between the first and second side edges;

a generally rigid faux bottom panel generally congruent with the bottom panel and hinged thereto along said first lateral side edge;

a first carrier side panel extending generally vertically from the first side edge of the bottom panel;

a second carrier side panel extending generally vertically from the second side edge of the bottom panel;

a first flexible, collapsible carrier end panel fastened to and extending generally vertically from the third end side edge of the bottom panel and connected to the first carrier side panel and the second carrier side panel, said first carrier end panel foldable to enable the carrier side panels to be moved into closely opposed relationship;

a second flexible, collapsible carrier end panel fastened to and extending generally vertically from the fourth end side edge of the bottom panel and connected to the first carrier side panel and the second carrier side panel, said second carrier end, panel foldable to enable the carrier side panels to be moved into closely opposed relationship, said panels forming alternatively a carrier case with the faux bottom panel folded in opposed relation to the bottom panel, and a compact folded carrier case with the faux bottom panel folded in opposed relation with the first carrier side panel intermediate between the first and second carrier side panels;

a pocket in each carrier end panel and a stiffening insert slidable into each said pocket to maintain each said end panel in a planar, unfolded condition, wherein the insert is removable;

a rigid handle extending between the first carrier end panel and second carrier end panel, wherein the handle is attached at its opposite ends to the first carrier end panel and second carrier end panel at an upper side of said end panels approximately midway between the lateral sides of said end panels and is pivotally attached to the carrier end panels for rotation about an axis extending between the end panels to permit folding of the handle;

the collapsible carrier end panels each comprise a series of vertically extending, generally rectangular and rigid rib sections hinged together and foldable about said hinge connections.

19. A collapsible tool carrier comprising, in combination:

a flexible material, generally rectangular bottom panel including a first lateral side edge, a second lateral side edge, a third end side edge extending between the first and second lateral side edges, a fourth end side edge generally parallel to the third end side edge and extending between the first and second lateral side edges;

a generally rigid faux bottom panel generally congruent with the bottom panel and hinged thereto along said first lateral side edge;

a first carrier side panel extending generally vertically from the first side edge of the bottom panel;

a second carrier side panel extending generally vertically from the second side edge of the bottom panel;

a first flexible, collapsible carrier end panel fastened to and extending generally vertically from the third end side edge of the bottom panel and connected to the first carrier side panel and the second carrier side panel, said first carrier end panel foldable to enable the carrier side panels to be moved into closely opposed relationship;

a second flexible, collapsible carrier end panel fastened to and extending generally vertically from the fourth end side edge of the bottom panel and connected to the first carrier side panel and the second carrier side panel, said second carrier end panel foldable to enable the carrier side panels to be moved into closely opposed relationship;

said panels forming alternatively a carrier case with the faux bottom panel folded is opposed relation to the bottom panel, and a compact folded carrier case with the faux bottom panel folded in opposed relation with the first carrier side panel intermediate between the first and second carrier side panels; and a rigid handle extending between the first carrier end panel and second carrier end panel, said handle attached at its opposite ends to the first carrier end panel and second carrier end panel at an upper side of said end panels approximately midway between the lateral sides of said end panels, said handle pivotally attached to the carrier end panels for rotation about an axis extending between the end panels to permit folding of the handle.

* * * * *